US005501358A

United States Patent [19]

Hobday

[11] Patent Number: 5,501,358

[45] Date of Patent: Mar. 26, 1996

[54] BOTTOMLESS RECEPTACLE AND BI-FRUSTOCONICAL LINER SYSTEM

[76] Inventor: Robert Hobday, 373 Flour Ct., Westerville, Ohio 43082-1011

[21] Appl. No.: 382,796

[22] Filed: Feb. 2, 1995

[51] Int. Cl.[6] ..... B65F 1/06

[52] U.S. Cl. ..... 220/404; 220/908; 383/907; 383/76

[58] Field of Search ..... 220/404, 403, 220/400, 908; 383/907, 75, 76

[56] References Cited

U.S. PATENT DOCUMENTS

| | | | |
|---|---|---|---|
| 1,269,901 | 6/1918 | Burke . | |
| 1,394,197 | 10/1921 | Keeline . | |
| 1,715,861 | 6/1929 | Owen | 220/908 |
| 2,870,811 | 1/1959 | Harrison . | |
| 3,675,940 | 7/1972 | Crookston . | |
| 3,771,752 | 11/1973 | Meeh . | |
| 4,222,580 | 9/1980 | Krokonko . | |
| 4,869,912 | 9/1989 | McCoy et al. | 220/404 |
| 4,953,987 | 9/1990 | Schnaars | 383/75 |
| 5,295,606 | 3/1994 | Karwoski | 220/404 |
| 5,339,872 | 8/1994 | Marino | 383/907 |
| 5,358,138 | 10/1994 | Karwoski | 220/404 |
| 5,411,165 | 5/1995 | Ellis | 220/404 |

FOREIGN PATENT DOCUMENTS

| | | | |
|---|---|---|---|
| 1146996 | 3/1969 | United Kingdom | 220/404 |

*Primary Examiner*—Stephen J. Castellano
*Attorney, Agent, or Firm*—Richard C. Litman

[57] ABSTRACT

A system for receiving, storing, and removal of waste, laundry or other items comprises a frusto-conically shaped holder and a bi-frusto-coically shaped holder liner. The holder is open at a narrower top end and at a wider bottom end. The liner is held in place in the holder by folding a top portion of the liner above a middle section of the liner over the holder's top end, and fastenign wit with snaps. The shape of the liner allows filling of the liner with waste or other items to approximately the entire volume of the holder. Once the liner is full, it can easily be removed by lifting the the liner's top portion to free it from the holder, and then lifting the holder away from the liner. In this way, the necessity for lifting a heavy bag of waste or other items is avoided. The liner's opening is secured in a closed configuration through use of twist ties or by a drawstring integral with the liner's middle section.

6 Claims, 3 Drawing Sheets

BOTTOMLESS RECEPTACLE AND BI-FRUSTOCONICAL LINER SYSTEM

BACKGROUND OF THE INVENTION

1. Field of the Invention

The present invention relates generally to bags and supports for bags, and more specifically to article-receiving bags and holders for use with such bags. 2. Description of the Prior Art Flexible bags for refuse or laundry have been long and widely used. Because such bags as a first problem become quite heavy when filled, a variety of techniques have been used to reduce the burden of removing filled bags from supports that contain them. A second problem encountered during the use of such bags is how to make them large enough to hold a substantial volume of material without having an opening of unwieldy width. A wide opening in a bag tends to allow contents of the bag to fall out when the bag's support is separated from the bag. A third problem with flexible bags is that because of their flexibility, they tend to fall away from a support and close in upon themselves, making use impractical. Several attempts have been made to resolve these problems, all without complete success.

U.S. Pat. No. 1,269,901, issued to Rua E. Burke on Jun. 18, 1918, discloses a receiving bag of frusto-conical shape with means for holding an opening in an open position. The bag may not easily be released from and reattached to the holding means.

U.S. Pat. No. 1,394,197, issued to William F. Keeline on Oct. 8, 1921, discloses a receiving bag of frusto-conical shape, along with rivets used to connect the bag to a supporting frame. The bag is not releasable and refastenable.

U.S. Pat. No. 2,870,811, issued to Maurice Harrison on Jan. 27, 1959, discloses a two-layered receiving bag of frusto-conical shape with a means for holding an opening in an open position. The bag is stitched onto the holding means and may not easily be released from it.

U.S. Pat. No. 3,675,940, issued to James R. Crookston on Jul. 11, 1972, discloses a trash receptacle with means for holding a waste-receiving bag in an open position. The invention does not have an open bottom, so the user must lift the filled waste-receiving bag above the fullheight of the receptacle in order to remove it.

U.S. Pat. No. 3,771,752, issued to Robert F. Meeh on Nov. 13, 1973, discloses a trash receptacle of frusto-conical shape with means for holding an opening in an open position. The invention does not have an open bottom, so the user must lift the filled waste-receiving bag above the full height of the receptacle in order to remove it.

U.S. Pat. No. 4,222,580, issued to Joseph Krokonko on Sep. 16, 1980, discloses an open-bottomed waste receptacle. The patent specifically teaches that a waste-receiving bag for use with the waste receptacle must be shaped in such a way as to avoid engagement with a lower portion of the receptacle. Because of this teaching, this patent argues away from the present applicant's use of a liner that fills the entire volume of its holder, thereby maximizing storage capacity. This patent also fails to provide a snapping mechanism for retaining an open position of the bag in the receptacle.

None of the above inventions and patents, taken either singly or in combination, is seen to describe the instant invention as claimed.

SUMMARY OF THE INVENTION

The present invention provides a receptacle system for receiving, storing, and removal of waste, laundry or other items. The system addresses and surmounts the problems inherent in the prior art. The system comprises a frusto-conically shaped holder composed of relatively light-weight material, and a bi-frusto-conically shaped holder liner. The holder is open at a narrower top end and at a wider bottom end. The liner is constructed so that it has a wide, closed bottom end; a narrow middle section; and a wide, open top end. When placed in the holder, the liner is oriented so that its middle section is aligned with the holder's top end. The liner is held in place by pulling or folding a top portion of the liner above the liner's middle section down over the holder's top end and fastening it in that position. The shape of the liner allows filling of the liner with waste or other items to approximately the entire volume of the holder. Once the liner is full, it can easily be removed by lifting the liner's top portion to free it from the holder, and then lifting the holder away from the liner. In this way, the necessity for lifting a heavy liner full of waste or other items is avoided. A liner's opening is secured in a closed configuration through use of shielded, flexible wire or by a drawstring integral with the liner's middle section.

Accordingly, it is a principal object of the invention to allow easy removal of items received in a receiving liner by providing an open-bottomed holder for holding the liner.

It is another object of the invention to ensure that removal of an object-filled liner through the bottom of a liner-holder can be accomplished without obstruction of the liner by the holder.

It is a further object of the invention to maximize the filling capacity of the liner while retaining a shape consistent with the other objects of the invention, without creating an unnecesssarily large liner opening.

Still another object of the invention is to provide easy-to-use mechanisms for closure without adding substantially to manufacturing complexity.

Yet another object of the invention is to provide a liner suitable for repeated use, or alternately for a one-time use.

An additional object of the invention is to provide a liner and holder combination in which the liner is held in an open configuration by the holder, yet can quickly be released.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 3:
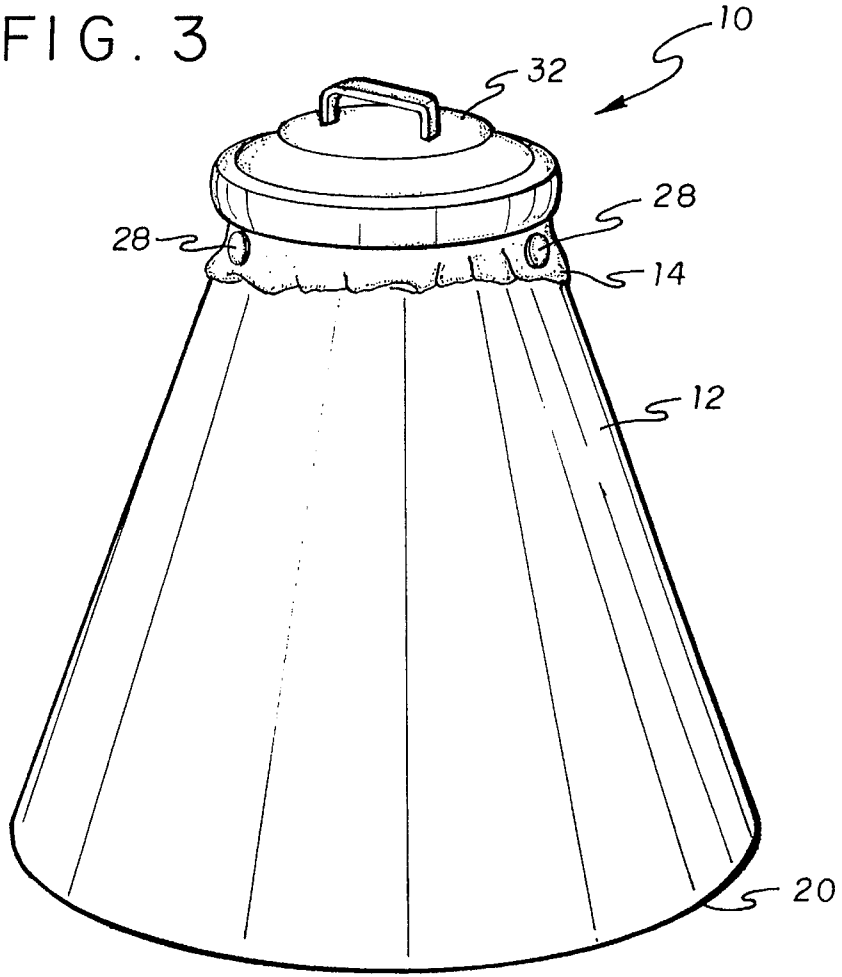
FIG. 3 is a prespective view of the holder, with a liner installed, and a cover placed on the holder.

The present invention provides a system for containing items, such as waste or laundry, in a holder, while at the same time making removal of the holder convenient and free from strain of a user's muscles.

Referring to the FIGS. 1–5, a system 10 according to the present invention comprises a frusto-conically shaped holder 12 and a bi-frusto-conically shaped holder liner 14. The invention is useful for receiving, storage, and removal of waste or other items (not shown). The holder 12, preferably constructed of a light-weight, durable substance such as polyethylene, is open at a narrower top end 16 having multiple snap-receiving members 18 disposed circumferentially, preferably three to four in number. The holder 12 is also open at a wider and circular bottom end 20 having a maximum radius.

Figure 5:
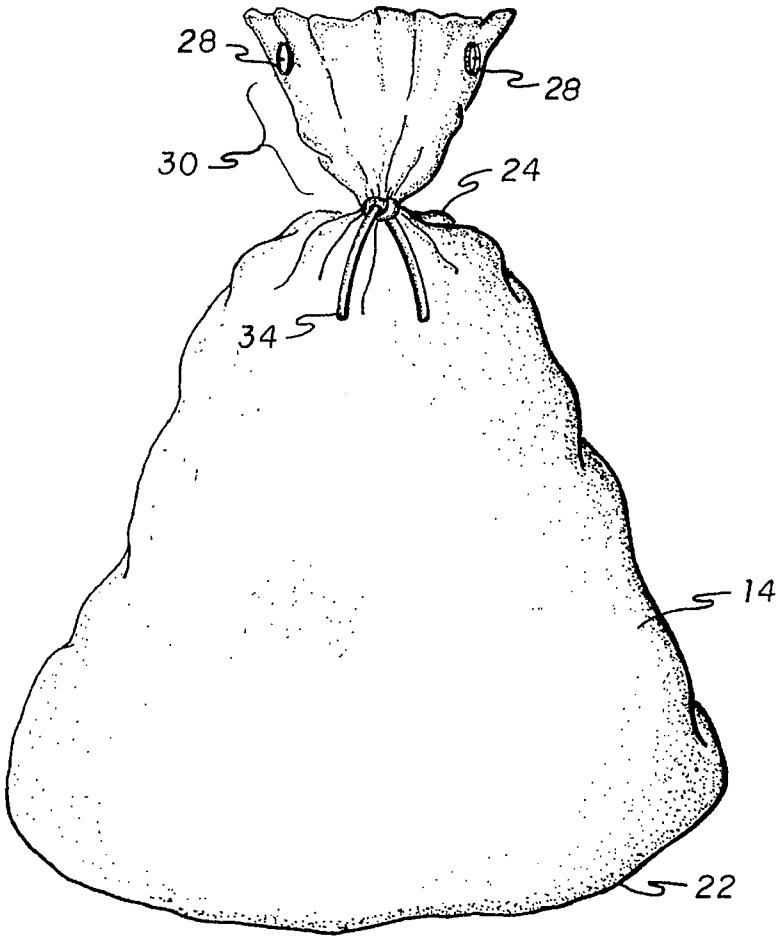
FIG. 5 is a side view of a filled liner tied closed with flexible, covered wire.
Figure 2:
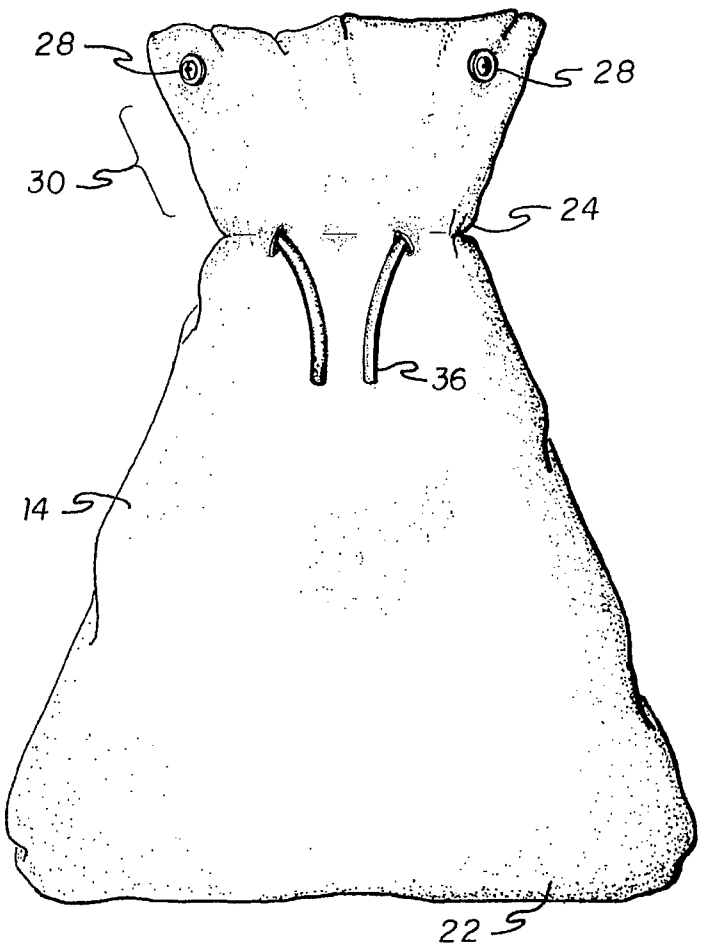
FIG. 2 is a side view of the liner according to the present invention, shown with drawstring, prior to insertion in a holder.

FIGS. 2 and 5 show that the liner 14 is constructed so that it has a wide, circular, closed bottom end 22 with a radius about the same length as that of the holder's bottom end 20. The liner 14 also has a narrow, circular middle section 24 and a wide, circular open top end 26. There are multiple snaps 28 circumferentially disposed on the top end 26, same in number and size as the snap-receiving members 18 on the top end or rim 16 of the holder 12. These snaps 28 are capable of releasably engaging the holder's 12 snap receiving members 18.

Figure 1:
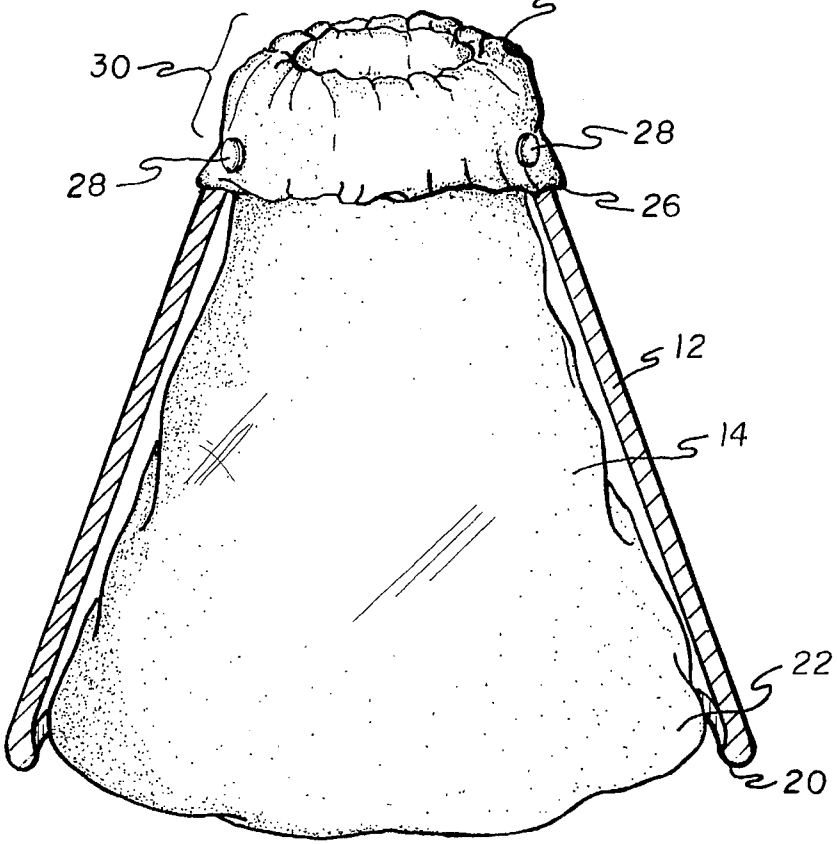
FIG. 1 is a perspective view of a liner and holder according to the present invention, with the holder shown in a partial sectional view.
Figure 4:
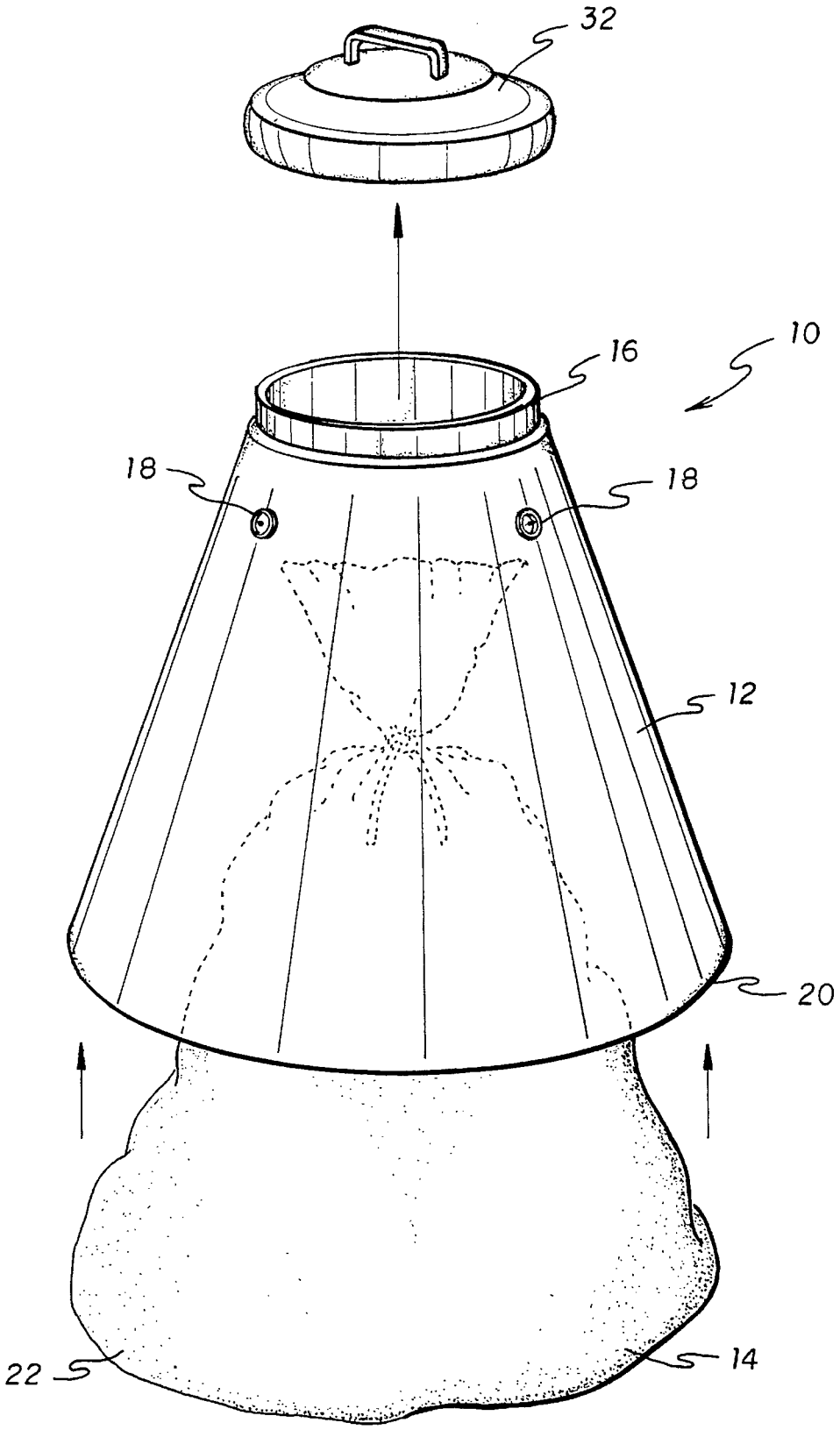
FIG. 4 is an exploded perspective view of the holder of the present invention being lifted away from an object-filled liner of the present invention, as in use.

When placed in the holder 12, the liner 14 is oriented so that its middle section 24 is aligned with the holder's 12 top end or rim 16 and the liner's 14 bottom end 22 extends to the holder's bottom end 20. The liner 14 is held in place by pulling or folding a top portion 30 of the liner 14 above and down over the holder's 12 top end or rim 16. Once folded over, the top portion 30 is snapped onto the holder 12, as shown in FIGS. 1 and 3. To ensure a separation of air between an interior volume of the holder 12 and space outside the holder 12, a cover 32 can be placed on the top end or rim 16 of the holder 12, as in FIG. 3.

The shape and size of the liner 14 are approximately the same as the holder's 12 shape and size, thereby allowing filling of the liner 14 with waste or other items to approximately the entire volume of the holder 12, as depicted in FIG. 1. Once the liner 14 preferably made of nylon or polyethylene, is full, it can be readied for removal. The liner's 14 top portion 30 is lifted to free it from the holder 12, and then the liner 14 is secured in a closed configuration, as in FIG. 5, through the use of a twist tie 34 or by a flat polyethylene, wire or braided cord drawstring 36 integral, i.e., within a laminated sleeve consisting of a plurality of thin, planar, flexible, elongated members, with the liner's 14 middle section 24, as in FIGS. 5 and 2, respectively. The liner 14 can then easily be removed by lifting the holder 12 away from the liner 14, as in FIG. 4, instead of lifting the liner 14 itself, as in many other receptacle systems. In this way, the necessity for lifting a heavy bag of waste, dirty laundry, or other items is avoided, and so is the strain and risk of injury associated with lifting such bags.

It is to be understood that the present invention is not limited to the sole embodiment described above, but encompasses any and all embodiments within the scope of the following claims.

I claim:

1. A receptacle for waste, laundry, or other articles comprising:

a flexible liner having a top partial-cone member with a wide, open, top end and a narrow connecting end, and a bottom partial-cone member with a wide, closed, bottom end and a narrow connecting end, said narrow connecting ends joined at a mid-liner intersection which is adapted to accommodate a closure element;

an integral partial-cone-shaped supporting holder with an open top and an open bottom end;

said bottom partial-cone member of said liner being sized to fit within said holder;

said top end of said holder has multiple snap receiving members disposed around said top end of said holder; and, said top partial-cone member of said liner has a corresponding number of multiple projecting snaps, each of said projecting snaps being capable of releasable insertion into each of said snap receiving members of said holder.

2. The receptacle according to claim 1, wherein there is a sleeve attached around the mid-liner intersection, and a sleeve-encased drawstring.

3. The receptacle according to claim 1, wherein said liner is closed, when desired, at said mid-liner intersection by use of an elongated, flexible wire enclosed in a flexible sheath.

4. The receptacle according to claim 2, wherein said sleeve is comprised by laminations of a plurality of thin, planar, flexible, elongated members.

5. The receptacle according to claim 2, wherein:

said liner is a nylon; and, said drawstring is a braided cord with a generally round cross-section.

6. The receptacle according to claim 2, wherein:

said liner is polyethylene; and, said drawstring is a flat, elongated polyethylene strap.

* * * * *